US009080424B2

(12) United States Patent
DiFoggio

(10) Patent No.: US 9,080,424 B2
(45) Date of Patent: Jul. 14, 2015

(54) SYSTEM AND METHOD FOR DOWNHOLE COOLING OF COMPONENTS UTILIZING ENDOTHERMIC DECOMPOSITION

(75) Inventor: Rocco DiFoggio, Houston, TX (US)

(73) Assignee: Baker Hughes Incorporated, Houston, TX (US)

( * ) Notice: Subject to any disclaimer, the term of this patent is extended or adjusted under 35 U.S.C. 154(b) by 358 days.

(21) Appl. No.: 12/627,626

(22) Filed: Nov. 30, 2009

(65) Prior Publication Data

US 2010/0147523 A1 Jun. 17, 2010

Related U.S. Application Data

(60) Provisional application No. 61/121,987, filed on Dec. 12, 2008.

(51) Int. Cl.
*E21B 47/01* (2012.01)

(52) U.S. Cl.
CPC ..... *E21B 47/011* (2013.01)

(58) Field of Classification Search
USPC ..... 166/302, 57, 65.1
See application file for complete search history.

(56) References Cited

U.S. PATENT DOCUMENTS 3,478,528 A * 11/1969 McCully ..... 62/3.1
5,184,470 A 2/1993 Moser et al.
5,697,218 A * 12/1997 Shnell ..... 60/641.2
6,224,784 B1 5/2001 Hayes
6,235,216 B1 5/2001 Hayes
6,238,591 B1 5/2001 Hayes
6,241,909 B1 6/2001 Hayes
6,241,910 B1 6/2001 Hayes
6,261,475 B1 7/2001 Hayes
6,264,854 B1 7/2001 Hayes
6,336,408 B1 1/2002 Parrott et al.
6,341,498 B1 1/2002 DiFoggio
6,672,093 B2 1/2004 DiFoggio
6,877,332 B2 4/2005 DiFoggio
7,124,596 B2 10/2006 DiFoggio et al.
7,228,902 B2 * 6/2007 Oppelt ..... 166/250.02
7,357,912 B2 4/2008 Sakai et al.
2005/0151554 A1 * 7/2005 Rae et al. ..... 324/760
2006/0086506 A1 4/2006 Golla et al.
2006/0191682 A1 * 8/2006 Storm et al. ..... 166/250.01
2008/0223579 A1 9/2008 Goodwin

OTHER PUBLICATIONS

International Preliminary Report on Patentability and Written Opinion, Mailed Jun. 23, 2011, International Appln. No. PCT/US2009/067723, Written Opinion 3 Pages, International Preliminary Report 2 Pages.

Bond Energy, [online]; [retrieved on Nov. 24, 2008]; retrieved from the Internet http://users.rcn.com/jkimball.ma.ultranet/BiologyPages/B/BondEnergy.

* cited by examiner

*Primary Examiner* — David Andrews
(74) *Attorney, Agent, or Firm* — Cantor Colburn LLP

(57) ABSTRACT

A system for controlling a temperature of a downhole component is disclosed. The system includes: a cooling material in thermal communication with the downhole component; and a container configured to house the cooling material therein, the cooling material configured to undergo an endothermic reaction and decompose at a selected temperature and absorb heat from the downhole component.

15 Claims, 4 Drawing Sheets

SYSTEM AND METHOD FOR DOWNHOLE COOLING OF COMPONENTS UTILIZING ENDOTHERMIC DECOMPOSITION

CROSS REFERENCE TO RELATED APPLICATIONS

This application claims the benefit of an earlier filing date from U.S. Provisional Application Ser. No. 61/121,987 filed Dec. 12, 2008, the entire disclosure of which is incorporated herein by reference.

BACKGROUND OF THE INVENTION

In hydrocarbon exploration and production operations, well boreholes are drilled by rotating a drill bit attached to a drillstring, and may be bored vertically or bored in selected directions via geosteering operations. Various downhole devices located in a bottomhole assembly or other locations along the drillstring measure various properties such as operating parameters and formation characteristics, and include sensors for determining the presence of hydrocarbons.

Various environmental influences, such as heat and pressure, put significant stress on components of exploration and/or production tools. For example, temperatures downhole in a borehole may exceed the maximum temperature capacity of some components of the tools. In addition, sensors and other electronics units may generate heat. Such heat generated by the tools and/or the formation pose a significant risk of overheating. Accordingly, cooling techniques such as evaporative cooling can be used to control the temperature of components in downhole tools to reduce or prevent degradation or deformation which could lead to tool failure and/or reduce the effective operating life of the components. However, such techniques are limited in the amount of heat that can be absorbed by evaporation.

BRIEF SUMMARY OF THE INVENTION

A system for controlling a temperature of a downhole component includes: a cooling material in thermal communication with the downhole component; and a container configured to house the cooling material therein, the cooling material configured to undergo an endothermic reaction and decompose at a selected temperature and absorb heat from the downhole component.

A method of controlling a temperature of a downhole component includes: disposing a cooling material in a container and in thermal communication with the downhole component; and disposing the downhole component in a borehole in an earth formation and exposing the cooling material to a selected temperature sufficient to cause the cooling material to undergo an endothermic reaction to decompose the cooling material at a selected temperature and absorb heat from the downhole component.

BRIEF DESCRIPTION OF THE DRAWINGS

The following descriptions should not be considered limiting in any way. With reference to the accompanying drawings, like elements are numbered alike.

DETAILED DESCRIPTION OF THE INVENTION

Figure 1:
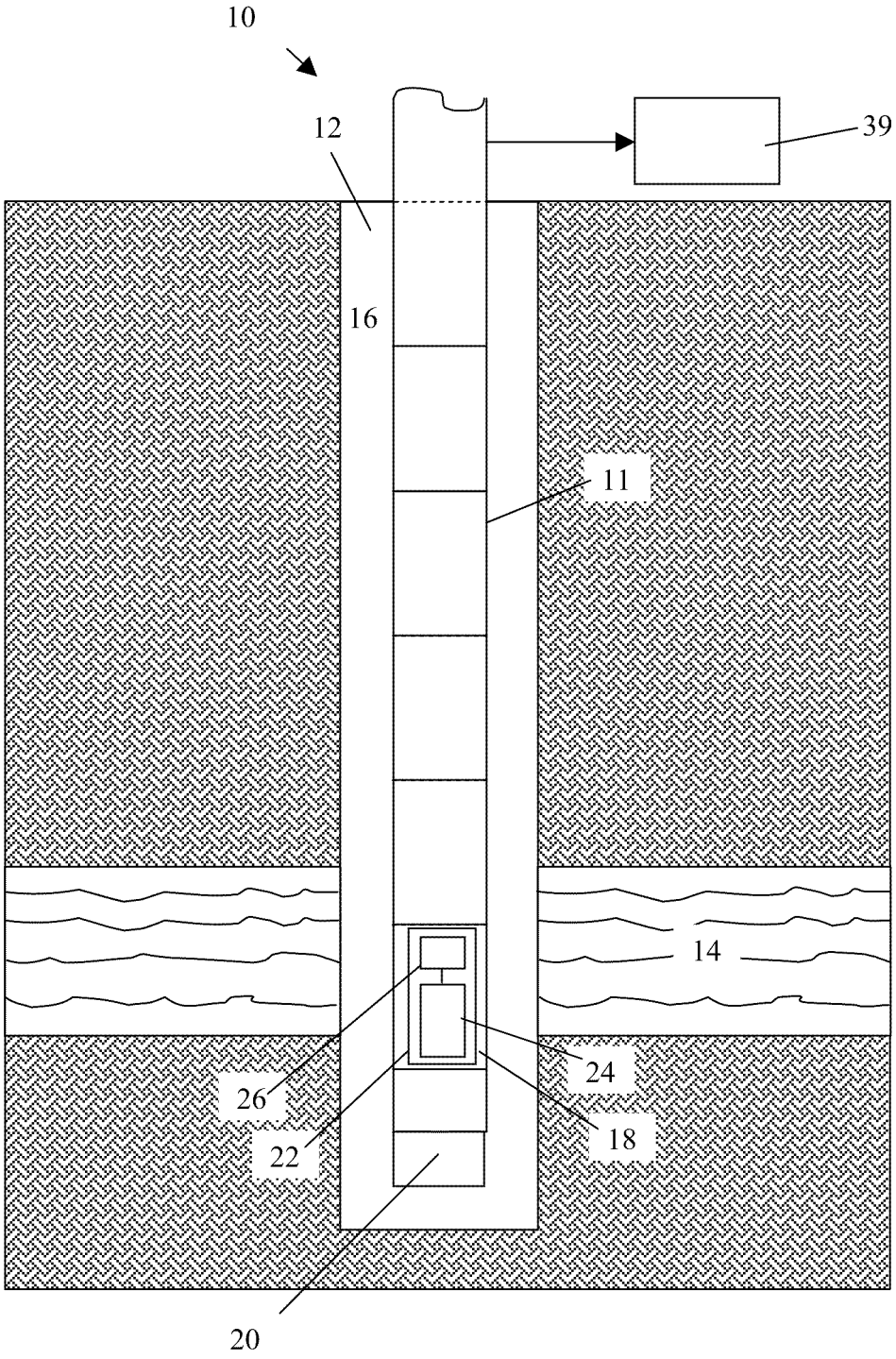
FIG. 1 depicts an embodiment of a well logging, production and/or drilling system.

Referring to FIG. 1, an exemplary embodiment of a well logging, production and/or drilling system 10 includes a drillstring 11 that is shown disposed in a borehole 12 that penetrates at least one earth formation 14 during a drilling, well logging and/or hydrocarbon production operation. The drillstring 11 includes a drill pipe, which may be one or more pipe sections or coiled tubing. The well drilling system 10 also includes a bottomhole assembly (BHA) 18. A borehole fluid 16 such as a drilling or completion fluid or drilling mud may be pumped through the drillstring 11, the BHA 18 and/or the borehole 12. In one embodiment, the BHA 18 includes a drilling assembly having a drill bit assembly 20 and associated motors adapted to drill through earth formations.

As described herein, "borehole" or "wellbore" refers to a single hole that makes up all or part of a drilled well. As described herein, "formations" refer to the various features and materials that may be encountered in a subsurface environment. Accordingly, it should be considered that while the term "formation" generally refers to geologic formations of interest, that the term "formations," as used herein, may, in some instances, include any geologic points or volumes of interest (such as a survey area) including the fluids contained therein. Furthermore, various drilling or completion service tools may also be contained within this borehole or wellbore, in addition to formations. In addition, it should be noted that "drillstring" or "string" as used herein, refers to any structure suitable for lowering a tool through a borehole or connecting a drill bit to the surface, and is not limited to the structure and configuration described herein. For example, the drillstring 11 is configured as a hydrocarbon production string or formation evaluation string.

The BHA 18, or other portion of the drillstring 11, includes a downhole tool 22. In one embodiment, the downhole tool 22 includes one or more sensors or receivers 24 to measure various properties of the borehole environment, including the formation 14 and/or the borehole 12. Such sensors 24 include, for example, nuclear magnetic resonance (NMR) sensors, resistivity sensors, porosity sensors, gamma ray sensors, seismic receivers, acoustic imagers and others. Such sensors 24 are utilized, for example, in logging processes such as wireline logging, measurement-while-drilling (MWD) and logging-while-drilling (LWD) processes.

The system 10 includes a downhole tool cooling system 26 to remove heat from a temperature sensitive tool component using an endothermic decomposition reaction to absorb heat from the tool component.

Figure 2:
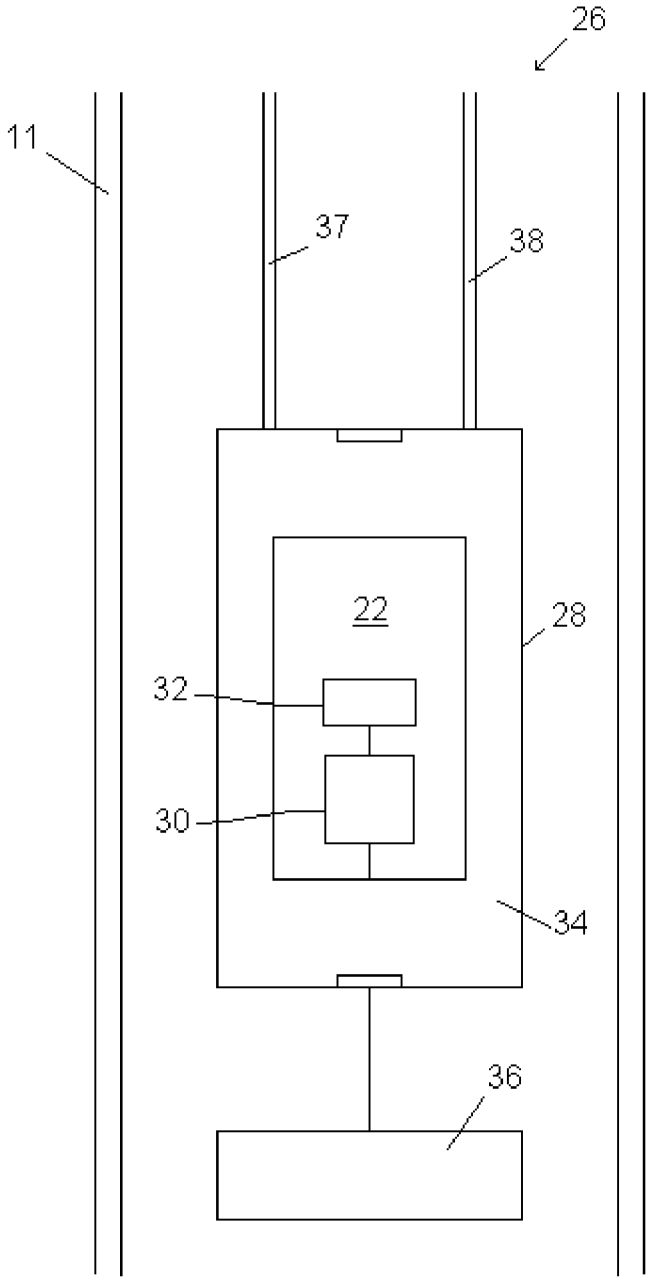
FIG. 2 depicts an embodiment of a cooling system of the system of FIG. 1.

Referring to FIG. 2, the cooling system 26 is disposed within or on the drillstring 11 and includes a housing 28 that surrounds one or more components of the tool 22 or is otherwise in thermal communication with one or more components of the tool 22. Examples of components include sensors 30, electronic components 32 such as controllers, processors and memory devices, and power sources such as batteries. Power for the downhole tool 22 and/or the cooling system is supplied by a battery, a wireline or any other suitable power supply method.

In one embodiment, the housing 28 is any container suitable to contain a cooling material (e.g., water) and/or one or more components of the tool 22. In one embodiment, the housing 28 is a Dewar flask or container that includes a cooling chamber 34 having the one or more components and the cooling material disposed therein. In one embodiment, the housing is composed of a highly thermally conductive material such as a metallic material. The housing optionally includes a cathode and an anode to which a voltage is applied by a power source to cause the cooling material to decompose (e.g., to cause water to decompose into $H_2$ and $O_2$).

The cooling material is included to absorb heat inside of the housing 28 and maintain the components therein at or below a selected temperature or temperature range. The cooling system 26 is configured to cause the cooling material to undergo an endothermic decomposition reaction. Heat is absorbed by the decomposition of the cooling material, such as water, by various means such as through exposure to a sufficient temperature, electrolysis or through contact with a hot catalyst. In one embodiment, the cooling material is placed adjacent to the component to be cooled. In another embodiment, a thermally conductive pad or other body is placed in contact with the component and the cooling material and/or the housing 28.

In one embodiment, a power unit 36 is connected to the cooling chamber 30 and is configured to apply an electric current to the cooling material disposed within the housing 28. Although the power unit 36 is shown as disposed within the drillstring 11, the power unit 36 may be disposed at any suitable location such as a surface location and electrically connected to the cooling chamber 34, such as via wireline connection.

In one embodiment, the power unit 32 is a thermoelectric power generator located, for example, at the mouth of the Dewar flask or other housing 28 to create electricity as the heat flows from outside the Dewar flask to its cooler interior. This electricity can then be used to electrolyze some water inside of the flask and cool the flask contents.

Passing a sufficient direct electric current through a cooling material, such as water, containing enough ions to make it a good electrical conductor, will cause the cooling material to break down into its constituents. For example, applying sufficient electric current to water will cause it to break down into hydrogen and oxygen.

In one embodiment, a hot catalyst is added to the cooling material to induce decomposition. For example, an acid or base material is added to the cooling material to adjust its acidity (pH) and correspondingly adjust the temperature at which the cooling material will decompose. For example, by adjusting the pH of water so that the Gibbs free energy change is less than zero, decomposition can be made to occur occurs at temperatures below 200 degrees C. without passing electricity through the water.

Applying a catalyst to a material such as water is effective to lower the temperature at which the material decomposes. For example, water decomposes spontaneously at 2200-2500 degrees C., which is much higher than typical geothermal borehole temperatures of about 300 degrees C. Accordingly, use of a catalyst is helpful to make water decompose at lower temperatures. In general, the higher the spontaneous decomposition temperature, the greater the heat that is absorbed by the decomposition. Therefore, in one embodiment, a material is used in conjunction with a catalyst to lower the material's decomposition to a selected temperature such as a temperature within the borehole temperature range.

In one embodiment, if a chemical catalyst is utilized to decompose the cooling material, acid and base catalysts are added to the cooling material to make it decompose at fairly low temperatures. Examples of such catalysts are described in U.S. Pat. No. 7,357,912, which is hereby incorporated by reference in its entirety. As the catalysts heat up from heat flowing into the flask, the water decomposes and keeps the interior temperature from rising too much.

Additional examples of catalysts include various catalysts applied to hydrocarbons to lower the temperature of decomposition, such as carbon catalysts. In one example, various carbon-based catalysts such as activated carbons (AC) and carbon blacks (CB) can be applied to methane or other hydrocarbons. Methane thermally decomposes into carbon and $H_2$ around 1200 C. and absorbs 75.6 kJ/mole in the process. Just as with water, catalysts can be used to lower the decomposition temperature by hundreds of degrees Celsius. Iron-based (e.g., M-Fe/$Al_2O_3$, where M=Mo, Pd, or Ni) or transition metal based materials can also by applied to hydrocarbons such as propane and cyclohexane. In one embodiment, various metal/transition metal catalysts are applied to a hydrocarbon cooling material via carbon nano-tubes (CNT).

Although the cooling material is described in some embodiments as water, any suitable materials may be utilized that decompose and absorb heat in response to electric current, temperature and/or a catalyst. Examples include bicarbonate of soda and hydrocarbons such as ethane, propane, methane, cyclohexane and natural gas.

Additional examples include so-called "chemical foaming agents" or "blowing agents" for foaming plastics. Such examples include Sulfonylsemicarbazides such as Celogen® RA manufactured by Chemtura Corporation, which decomposes at 226-235 C. Other examples include Safoam® RPC manufactured by AMCO Plastic Materials Inc., which decomposes at 182-316 degrees C.

In one embodiment, to prevent accidental (and highly exothermic) recombination of the constituents of the decomposed cooling material or compound, the cooling system includes a number of tubes or other conduits to separate the constituents and transmit the constituents separately to a remote location. For example, if the cooling material is water, the hydrogen and oxygen resulting from decomposition are conveyed to a remote location, such as a remote containment chamber within the tool or pumped entirely out of the tool into the wellbore fluid, through separate conduits 37 and 38. In another embodiment, the hydrogen and oxygen (or other constituents) are separated by a membrane that selectively transmits one gas but not the other to prevent recombination.

Referring again to FIG. 1, in one embodiment, the cooling system 26 and/or the BHA 18 are in communication with a surface processing unit 39. In one embodiment, the surface processing unit 39 is configured as a control unit to control the cooling remotely. The BHA 18, the tool 22, and/or the cooling system 26 incorporates any of various transmission media and connections, such as wired connections, fiber optic connections, wireless connections and mud pulse telemetry.

In one embodiment, the surface processing unit 39 includes components as necessary to provide for storing and/or processing data collected from the tool 22. Exemplary components include, without limitation, at least one processor, storage, memory, input devices, output devices and the like.

Although the cooling system is described in conjunction with the drillstring 11, the cooling system may be used in conjunction with any structure suitable to be lowered into a borehole, such as a production string or a wireline. Furthermore, the cooling system may be used with any type of downhole tool.

Figure 3:
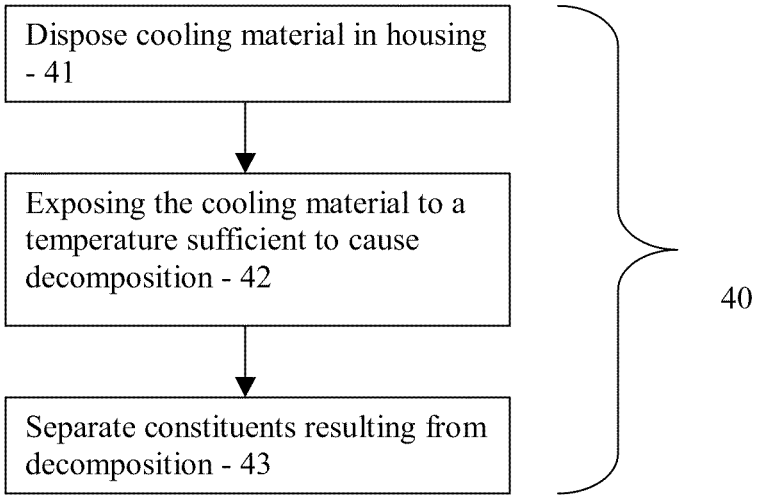
FIG. 3 is a flow chart depicting an embodiment of a method of controlling the temperature of a downhole component.

FIG. 3 illustrates a method 40 of controlling the temperature of a downhole tool or component. The method 40 is used in conjunction with the cooling system 26 and the tool 22, although the method 40 may be utilized in conjunction with any BHA or any type or number of downhole tools. The method 40 includes one or more stages 41, 42 and 43. In one embodiment, the method 40 includes the execution of all of stages 41-43 in the order described. However, certain stages may be omitted, stages may be added, or the order of the stages changed.

In the first stage 41, the cooling material such as water is disposed in the housing 28 and in thermal communication with the tool 22 or one or more components thereof.

In the second stage 42, the cooling material is exposed to temperatures sufficient to cause the cooling material to decompose. In one embodiment, a catalyst such as an electric current, an acid and/or a base is applied to the cooling material to cause the cooling material to undergo an endothermic reaction and decompose at a selected temperature (e.g., a temperature at a downhole location in the borehole 12) and absorb heat from the tool 22.

In one embodiment, applying the catalyst includes applying an electric current to the cooling material sufficient to cause decomposition at the selected temperature. In another embodiment, applying the catalyst includes disposing the acid and/or the base in the housing 28 with the cooling material to adjust the acidity of the cooling material so that the cooling material will decompose at the selected temperature.

In the third stage 43, resultant constituents of the decomposition are separated to prevent recombination into the cooling material, which would result in the release of heat to surrounding areas. In one embodiment, the constituents are separately conveyed to a remote location such as the surface via the conduits 37 and 38. In another embodiment, the constituents are conveyed to a chamber that includes a membrane sufficient to separate the constituents.

Figure 4:
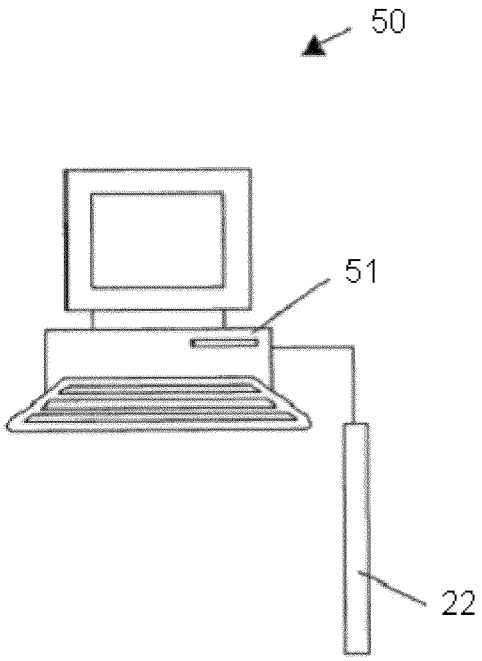
FIG. 4 is an embodiment of a system for controlling the temperature of a downhole component.

Referring to FIG. 4, there is provided a system 50 for controlling a temperature of a downhole component located in a borehole string. The system may be incorporated in a computer 51 or other processing unit capable of receiving data from the tool 22, the BHA 18 and/or the cooling system. Exemplary components of the system 50 include, without limitation, at least one processor, storage, memory, input devices, output devices and the like. As these components are known to those skilled in the art, these are not depicted in any detail herein.

Generally, some of the teachings herein are reduced to instructions that are stored on machine-readable media. The instructions are implemented by the computer 51 and provide operators with desired output.

The systems and methods described herein provide various advantages over prior art techniques. Endothermic chemical reactions such as those described above are capable of absorbing significantly more heat than other techniques such as sorption cooling. Among common liquids, for example, water has the highest heat of evaporation. Even so, the heat per mole that water absorbs during decomposition is approximately 6 times greater than the heat that water absorbs during evaporation, so very little water needs to be decomposed to produce significant cooling. For example, water decomposition absorbs 59 kcal/mole, which is 59,000 cal/mole of water or 3278 cal/cc or 4186.8 joules/mole or 4186.8 joules per 18 cc or 232.6 joules/cc. By contrast, water evaporation absorbs 2274 J/g, which is 543 cal/cc or 9,744 cal/mole. Therefore, water decomposition absorbs 6.03 times as much heat per unit of liquid water than does water evaporation. Thus the system and method described herein is capable of more effectively cooling components and also requires less water than other techniques.

In support of the teachings herein, various analyses and/or analytical components may be used, including digital and/or analog systems. The system may have components such as a processor, storage media, memory, input, output, communications link (wired, wireless, pulsed mud, optical or other), user interfaces, software programs, signal processors (digital or analog) and other such components (such as resistors, capacitors, inductors and others) to provide for operation and analyses of the apparatus and methods disclosed herein in any of several manners well-appreciated in the art. It is considered that these teachings may be, but need not be, implemented in conjunction with a set of computer executable instructions stored on a computer readable medium, including memory (ROMs, RAMs), optical (CD-ROMs), or magnetic (disks, hard drives), or any other type that when executed causes a computer to implement the method of the present invention. These instructions may provide for equipment operation, control, data collection and analysis and other functions deemed relevant by a system designer, owner, user or other such personnel, in addition to the functions described in this disclosure.

Further, various other components may be included and called upon for providing aspects of the teachings herein. For example, a sample line, sample storage, sample chamber, sample exhaust, filtration system, pump, piston, power supply (e.g., at least one of a generator, a remote supply and a battery), vacuum supply, pressure supply, refrigeration (i.e., cooling) unit or supply, heating component, motive force (such as a translational force, propulsional force or a rotational force), magnet, electromagnet, sensor, electrode, transmitter, receiver, transceiver, controller, optical unit, electrical unit or electromechanical unit may be included in support of the various aspects discussed herein or in support of other functions beyond this disclosure.

One skilled in the art will recognize that the various components or technologies may provide certain necessary or beneficial functionality or features. Accordingly, these functions and features as may be needed in support of the appended claims and variations thereof, are recognized as being inherently included as a part of the teachings herein and a part of the invention disclosed.

While the invention has been described with reference to exemplary embodiments, it will be understood by those skilled in the art that various changes may be made and equivalents may be substituted for elements thereof without departing from the scope of the invention. In addition, many modifications will be appreciated by those skilled in the art to adapt a particular instrument, situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

The invention claimed is:

1. A system for controlling a temperature of a downhole component, the system comprising:

a carrier configured to be disposed in a borehole in an earth formation, the carrier including a downhole component;

a cooling material in thermal communication with the downhole component, the cooling material including water; and a container disposed in the carrier, the container configured to house the cooling material therein, the cooling material configured to undergo an endothermic reaction and decompose at least the water into hydrogen and oxygen constituents at a selected temperature without reliance on a chemical intermediary, the endothermic reaction and cooling material configured to absorb heat from the downhole component and maintain the downhole component at or below a selected temperature; and a catalyst configured to lower a decomposition temperature, at which the water decomposes without reliance on a chemical intermediary, to the selected temperature.

2. The system of claim 1, wherein the catalyst is configured to operably contact the cooling material and cause the water to decompose at a temperature corresponding to a downhole temperature.

3. The system of claim 1, wherein the catalyst is an electric current sufficient to cause the water to decompose at the selected temperature.

4. The system of claim 3, further comprising an electric power source in electrical communication with the cooling material, and a pair of electrodes disposed on the container and in electrical communication with the electric power source.

5. The system of claim 1, further comprising a thermoelectric power generator configured to generate electricity using heat flowing toward the cooling material as a result of the endothermic reaction.

6. The system of claim 4, wherein the electric power source is selected from at least one of a downhole power source and a surface power source.

7. The system of claim 6, wherein the downhole power source is at least one battery.

8. The system of claim 1, wherein the downhole component is disposed in the container in thermal contact with the cooling material.

9. The system of claim 1, further comprising a plurality of conduits in fluid communication with the container and configured to separately convey constituents of the cooling material to a remote location.

10. The system of claim 1, further comprising a membrane configured to separate constituents of the cooling material to prevent recombination of the constituents.

11. A method of controlling a temperature of a downhole component, the method comprising:

disposing a cooling material in a container and in thermal communication with the downhole component, the cooling material including water;

disposing the downhole component in a borehole in an earth formation;

applying a catalyst to the cooling material, the catalyst configured to lower a decomposition temperature, at which the water directly decomposes without reliance on a chemical intermediary, to a selected temperature; and exposing the cooling material to the selected temperature sufficient to cause the cooling material to undergo an endothermic reaction to decompose at least the water into hydrogen and oxygen constituents without reliance on a chemical intermediary, absorb heat from the downhole component and maintain the downhole component at or below a selected temperature.

12. The method of claim 11, wherein the selected temperature corresponds to a downhole temperature.

13. The method of claim 11, wherein applying the catalyst includes applying an electric current to the cooling material sufficient to cause the water to decompose at the selected temperature.

14. The method of claim 11, wherein the downhole component is disposed in the container in thermal contact with the cooling material.

15. The method of claim 11, further comprising generating electricity using heat flowing toward the cooling material as a result of the endothermic reaction, and using the electricity to electrolyze at least some of the water and cool the downhole component.

* * * * *